US010989006B2

(12) United States Patent
Durst et al.

(10) Patent No.: US 10,989,006 B2
(45) Date of Patent: Apr. 27, 2021

(54) CREATION OF A WINDOW OPENING/EXIT UTILIZING A SINGLE TRIP PROCESS

(71) Applicant: Halliburton Energy Services, Inc., Houston, TX (US)

(72) Inventors: Douglas Glenn Durst, Schertz, TX (US); Loyd Eddie East, Jr., Fannin, TX (US); Benjamin Luke Butler, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 263 days.

(21) Appl. No.: 16/320,028

(22) PCT Filed: Feb. 22, 2018

(86) PCT No.: PCT/US2018/019218
§ 371 (c)(1),
(2) Date: Jan. 23, 2019

(87) PCT Pub. No.: WO2019/164493
PCT Pub. Date: Aug. 29, 2019

(65) Prior Publication Data
US 2021/0054707 A1 Feb. 25, 2021

(51) Int. Cl.
*E21B 29/06* (2006.01)

(52) U.S. Cl.
CPC ..... *E21B 29/06* (2013.01)

(58) Field of Classification Search
CPC ..... E21B 29/06
See application file for complete search history.

(56) References Cited

U.S. PATENT DOCUMENTS

| | | | | |
|---|---|---|---|---|
| 5,636,692 | A | 6/1997 | Haugen | |
| 5,765,756 | A | 6/1998 | Jordan et al. | |
| 5,791,417 | A * | 8/1998 | Haugen | E21B 7/061 166/298 |
| 5,813,465 | A | 9/1998 | Terrell et al. | |
| 5,887,668 | A | 3/1999 | Haugen et al. | |

(Continued)

FOREIGN PATENT DOCUMENTS

| | | |
|---|---|---|
| EP | 2391793 | 5/2017 |
| GB | 2316424 | 2/1998 |
| WO | 2017099780 | 6/2017 |

OTHER PUBLICATIONS

International Search Report and Written Opinion for PCT/US2018/019218 dated Feb. 22, 2018.

(Continued)

*Primary Examiner* — Taras P Bemko
(74) *Attorney, Agent, or Firm* — Scott Richardson; C. Tumey Law Group PLLC

(57) ABSTRACT

This disclosure may generally relate to drilling operations and, more particularly, to systems and methods for side-tracking an existing well. A bottom hole assembly may comprise a milling assembly, a whipstock coupled to the milling assembly, wherein the whipstock comprises an inclined ramp configured for diverting the milling assembly toward a casing string, and a downhole subassembly coupled to the whipstock, wherein the downhole subassembly comprises a body portion and one or more components on the body portion operable to weaken and/or remove material from the casing string.

20 Claims, 8 Drawing Sheets

(56) References Cited

U.S. PATENT DOCUMENTS

| | | | |
|---|---|---|---|
| 6,105,675 | A | 8/2000 | Buytaert et al. |
| 6,170,576 | B1 | 1/2001 | Brunnert et al. |
| 6,286,599 | B1 | 9/2001 | Surjaatmadja et al. |
| 6,318,466 | B1 | 11/2001 | Ohmer et al. |
| 6,668,945 | B2 | 12/2003 | Ohmer |
| 6,695,056 | B2 | 2/2004 | Haugen et al. |
| 6,708,762 | B2 | 3/2004 | Haugen et al. |
| 6,729,406 | B1 | 5/2004 | Collins et al. |
| 6,755,248 | B2 | 6/2004 | Toulouse et al. |
| 7,140,444 | B2 | 11/2006 | Mackay |
| 7,380,603 | B2 | 6/2008 | Jeffrey et al. |
| 7,527,092 | B2 | 5/2009 | McAfee |
| 7,537,055 | B2 | 5/2009 | Head et al. |
| 7,540,327 | B2 | 6/2009 | Billingham |
| 7,690,428 | B2 | 4/2010 | Robertson |
| 7,810,568 | B2 | 10/2010 | Toulouse |
| 7,814,978 | B2 | 10/2010 | Steele et al. |
| 8,074,744 | B2 | 12/2011 | Watson et al. |
| 8,167,060 | B2 | 5/2012 | Brunet et al. |
| 8,186,458 | B2 | 5/2012 | Dewey et al. |
| 8,475,230 | B2 | 7/2013 | Summers et al. |
| 8,757,262 | B2 | 6/2014 | Dotson |
| 8,770,316 | B2 | 7/2014 | Jelsma |
| 8,794,331 | B2 | 8/2014 | Getzlaf et al. |
| 8,893,788 | B2 | 11/2014 | Tunney et al. |
| 10,364,607 | B2 * | 7/2019 | Stokes ..... E21B 7/06 |
| 2002/0170713 | A1 | 11/2002 | Haugen et al. |
| 2005/0269083 | A1 | 12/2005 | Burris et al. |
| 2007/0284106 | A1 | 12/2007 | Kalman et al. |
| 2008/0185148 | A1 | 8/2008 | Carter et al. |
| 2009/0288833 | A1 | 11/2009 | Graham et al. |
| 2011/0155377 | A1 | 6/2011 | Laun |
| 2013/0192830 | A1 | 8/2013 | Watson et al. |
| 2015/0027695 | A1 | 1/2015 | Mtchell et al. |
| 2015/0075793 | A1 | 3/2015 | Dotson et al. |
| 2016/0348455 | A1 | 12/2016 | Haq et al. |
| 2018/0274300 | A1 * | 9/2018 | Vemuri ..... E21B 7/061 |

OTHER PUBLICATIONS

"Technically Advanced Tools and Services for Downhole Fishing", Knight Oil Tools, p. 1-5.

Oberkircher, "New system reduces multilateral completion time", Drilling Contractor, 2000.

* cited by examiner

CREATION OF A WINDOW OPENING/EXIT UTILIZING A SINGLE TRIP PROCESS

BACKGROUND

Wells may be drilled into subterranean formations to recover valuable hydrocarbons. Various operations may be performed before, during, and after the well has been drilled to produce and continue the flow of the hydrocarbon fluids to the surface.

A typical operation concerning oil and gas operations may be to sidetrack a well. Sidetracking a well may include creating a window, or a hole, in the casing of the original well and drilling out of that window through subterranean formations to reach a new target. This may be done intentionally or accidentally. There may be a number of reasons why it may be desirable to sidetrack a well. The operation may be required if there is an object or tool stuck in the original well that cannot be fished out, the wellbore has collapsed, there is a desire to bypass a section of the original well, or a new subterranean formation is to be explored nearby. Traditionally, the process of sidetracking a well may require multiple tool assemblies and steps that take time for completing the operation. It may be desirable to combine trips downhole and procedures to reduce the amount of time it takes for completion and to increase efficiency. The casing strings that line the drilled-out wellbore may be made of strong, durable material. The milling assembly used to create the window has to drill through the casing strings. It may be suitable to first weaken the area of the casing strings to be drilled through prior to creating the window.

BRIEF DESCRIPTION OF THE DRAWINGS

These drawings represent certain aspects of the present invention and should not be used to limit or define the disclosure.

DETAILED DESCRIPTION

This disclosure may generally relate to drilling operations and, more particularly, to systems and methods for sidetracking an existing well. Specifically, examples of the present disclosure may include weakening a casing string prior to creating a window to drill through.

A system and method may be used to create a single trip window exit within a casing string of a well. A milling assembly may be used in conjunction with a whipstock to create a long, straight window exit. The whipstock may direct the milling assembly to travel towards an inside portion of the casing string at an angle. Additional tools and equipment may be used to weaken the inside portion of the casing string prior to the milling assembly coming into contact with the casing string.

Figure 1:
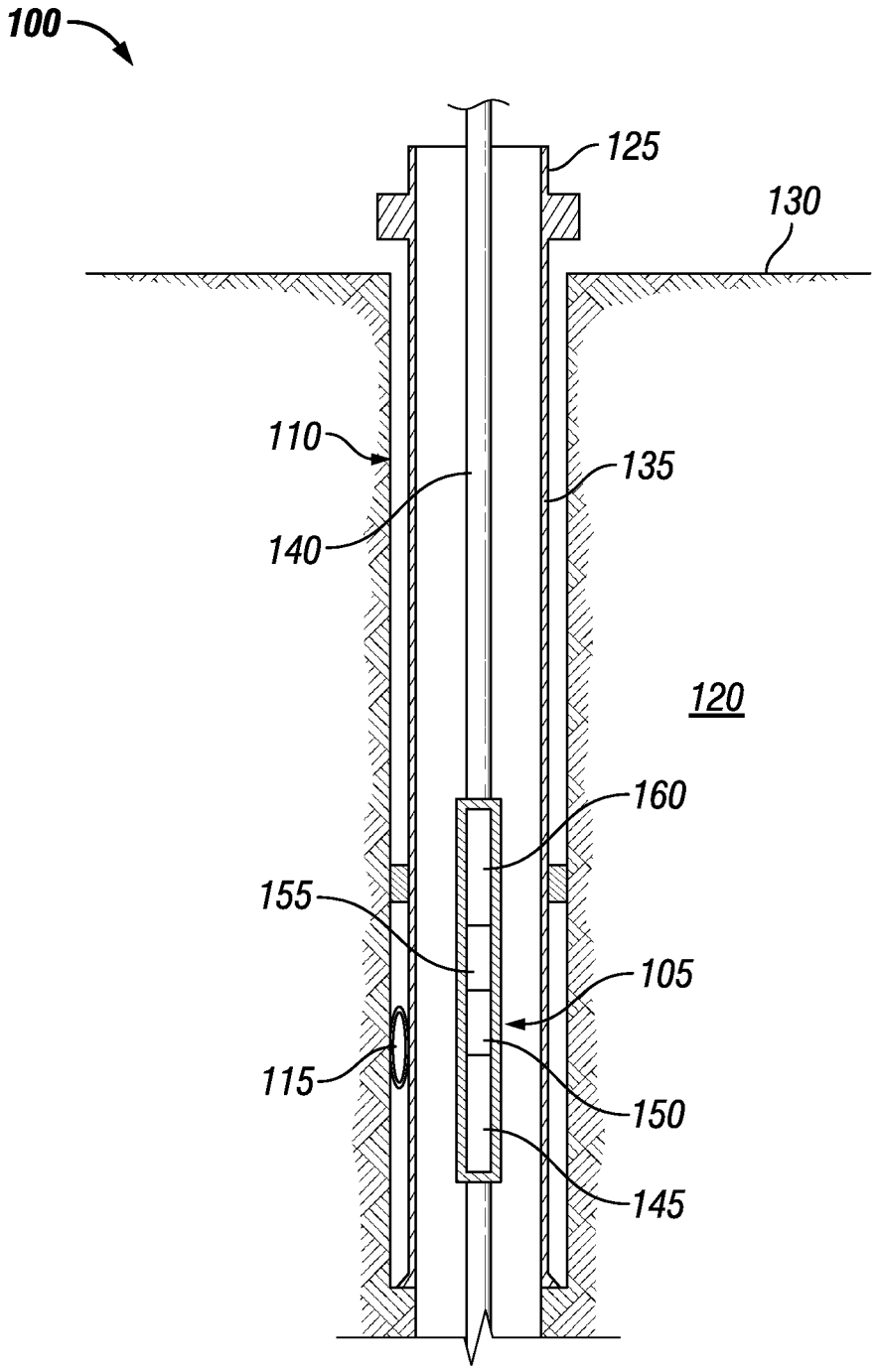
FIG. 1 illustrates an example of a downhole system.

FIG. 1 illustrates an example of a downhole system 100 that includes a bottom hole assembly 105. FIG. 1 illustrates use of bottom hole assembly 105 after completion of a well. In examples, it may be desirable to extend outwards from a completed wellbore 110. There may be numerous reasons why an operator may want to do so, such as, discovering a nearby area of interest and/or dwindling production. Bottom hole assembly 105 may be utilized to create an exit window 115, wherein exit window 115 may be a hole or opening along the side of wellbore 110. Further drilling operations through exit window 115 may be desired, and subsequent drilling equipment may be implemented to explore a nearby formation 120.

FIG. 1 further illustrates wellbore 110 extending from a wellhead 125 at the subterranean surface 130 downward into the Earth into one or more formations 120. A portion of wellbore 110 extending from wellhead 125 to formation 120 is lined with lengths of tubing, called casing 135. Casing 135 may be in the form of an intermediate casing, a production casing, a liner, or other suitable conduit, as will be appreciated by those of ordinary skill in the art. While not illustrated, additional conduits may also be installed in wellbore 110 as desired for a particular application. In the illustrated embodiment, casing 135 may be cemented to the walls of wellbore 110.

A conveyance line 140 is shown as having been lowered from the surface 130 into the wellbore 110. Conveyance line 140 may include any suitable means for providing mechanical conveyance for a bottom hole assembly 105, including, but not limited to, wireline, slickline, coiled tubing, pipe, tool string, drill pipe, drill string or the like. In some examples, conveyance line 140 may provide mechanical suspension, as well as electrical connectivity, for bottom hole assembly 105. Conveyance line 140 may lower bottom hole assembly 105 through wellbore 110 to a desired depth.

Bottom hole assembly 105 may further comprise a whipstock 145, a milling assembly 150, a spacer pipe 155, and a downhole subassembly 160. Whipstock 145 may be used to divert milling assembly 150 into a side of casing 135 of wellbore 110. Prior to operating milling assembly 150, downhole subassembly 160 may be used to weaken an area of a side of casing 135 that is to be drilled through by milling assembly 150. Spacer pipe 155 may be a length of pipe spaced between the other components of bottom hole assembly 105 for measurement purposes. The combined operation of these components within bottom hole assembly 105 may produce exit window 115 within casing 135 and wellbore 110 for a desired alternate route of exploration.

As illustrated, a wellbore 110 may extend through formation 120 and/or a plurality of formations 120. While wellbore 110 is shown extending generally vertically into formation 120, the principles described herein are also applicable to wellbores that extend at an angle through formation 120, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

Figure 2:
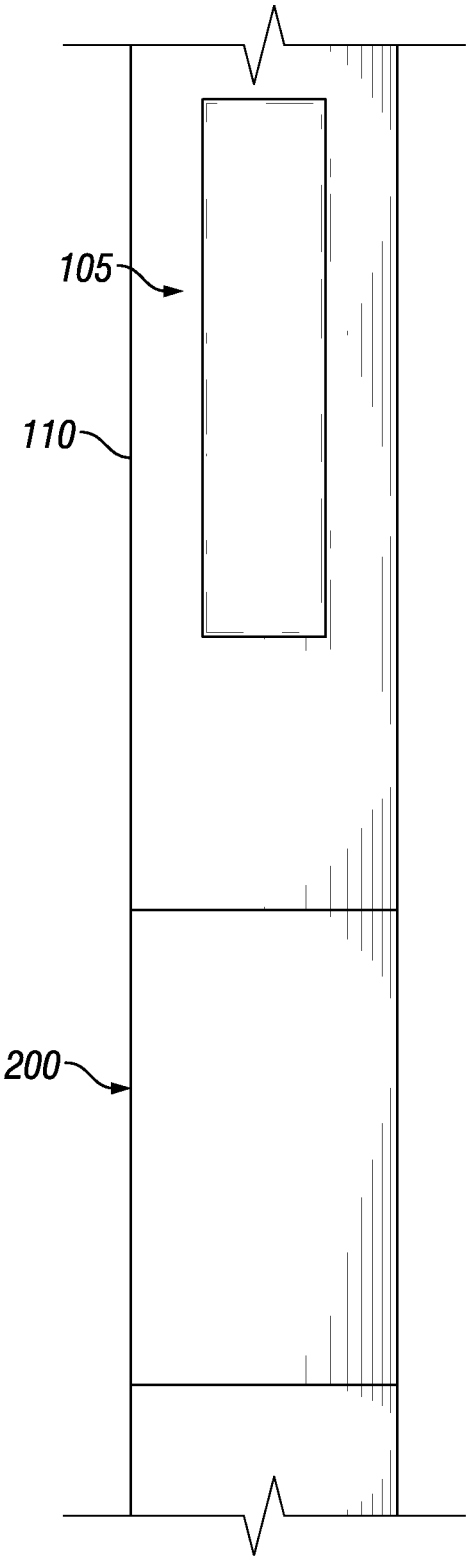
FIG. 2 illustrates an example of securing a bottom hole assembly.

FIG. 2 illustrates an example of securing bottom hole assembly 105 in wellbore 110. During operations, bottom hole assembly 105 may be lowered into wellbore 110. Once bottom hole assembly 105 reaches a specified depth, bottom hole assembly 105 may need to be secured so as to prevent further displacement. Securing apparatus 200 may be implemented to prevent bottom hole assembly 105 from rotation and/or translation.

Securing apparatus 200 may receive an end or a portion of an end of bottom hole assembly 105. Securing apparatus 200 may be any suitable size, height, and/or shape which may accommodate the end or the portion of an end of bottom hole assembly 105. Without limitation, a suitable shape may include, but is not limited to, cross-sectional shapes that are circular, elliptical, triangular, rectangular, square, hexagonal, and/or combinations thereof. Securing apparatus 200 may be made from any suitable material. Suitable materials may include, but are not limited to, metals, nonmetals, polymers, ceramics, and/or combinations thereof. Without limitation, securing apparatus 200 may include profile devices, packers, and/or combinations thereof.

Figure 3:
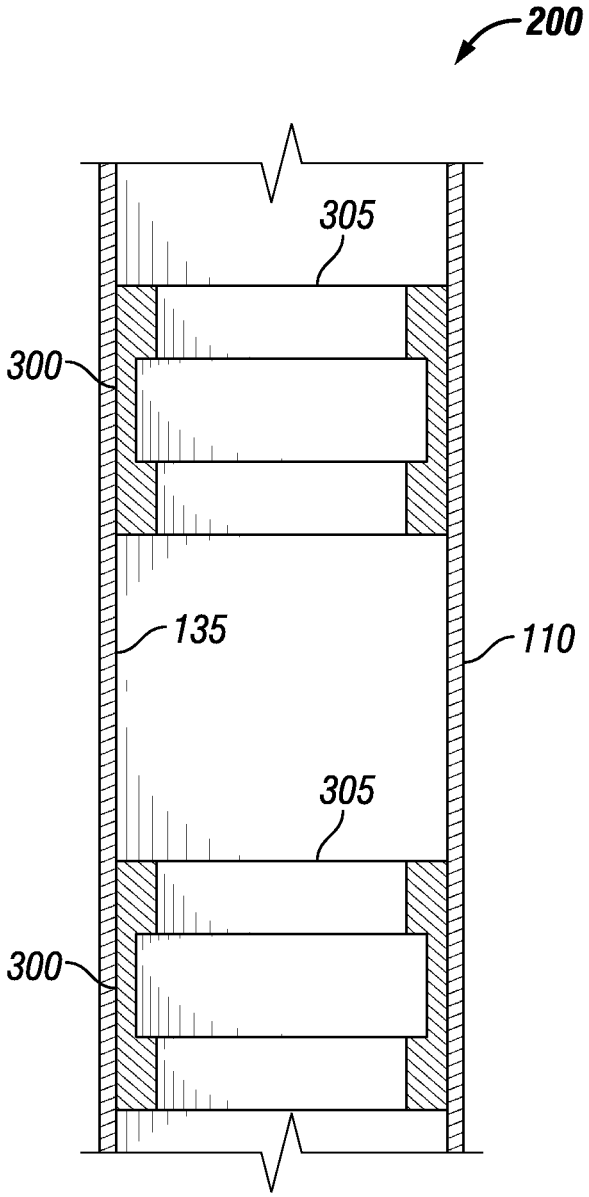
FIG. 3 illustrates an example of a profile device.

FIG. 3 illustrates an example of a profile device 300 for use in securing apparatus 200. As illustrated, profile device 300 may be disposed in wellbore 110. Profile device 300 may be pre-installed in wellbore 110 and/or installed in an existing wellbore 110. In examples, profile device 300 may be integrated into an anchor packer and installed in the post well construction of wellbore 110. Profile device 300 may be made from any suitable material. Suitable materials may include, but are not limited to, metals, nonmetals, polymers, ceramics, and/or combinations thereof. Profile device 300 may be any suitable size, height, and/or shape. Without limitation, a suitable shape may include, but is not limited to, cross-sectional shapes that are circular, elliptical, triangular, rectangular, square, hexagonal, and/or combinations thereof. In examples, profile device 300 may be cylindrical and may have an inner and outer diameter. There may be an opening 305 that traverses the length from one end of profile device 300 to the other. In examples, there may be ridges and/or grooves running along the inner diameter of profile device 300. The ridges and/or grooves may accommodate the end or the portion of an end of bottom hole assembly 105 (e.g., referring to FIG. 1). In examples, bottom hole assembly 105 (e.g., referring to FIG. 1) may enter into opening 305 through an end of profile device 300. The ridges and/or grooves of profile device 300 may interact with the end or the portion of an end of bottom hole assembly 105 (e.g., referring to FIG. 1) to prevent bottom hole assembly 105 from exiting opening 305 through an opposing end of profile device 300. In examples, bottom hole assembly 105 may latch into place within profile device 300.

Profile device 300 may be disposed as a part of casing 135 of wellbore 110. Profile device 300 may be disposed as a part of casing 135 using any suitable mechanism, including, but not limited, through the use of suitable fasteners, threading, adhesives, welding and/or any combination thereof. Without limitation, suitable fasteners may include nuts and bolts, washers, screws, pins, sockets, rods and studs, hinges and/or any combination thereof. There may be a plurality of profile devices 300. As illustrated, a pair of profile devices 300 may be disposed in wellbore 110. In other examples, profile device 300 may be disposed about a packer. In examples, the packer may be used to seal-off and contain produced fluids and pressures within casing 135. Additionally, the packer may be used as a barrier to prevent further displacement of an object or material past the packer. During operations, as the packer may be disposed through wellbore 110, profile device 300 may be displaced accordingly. As the packer anchors itself to casing 135 of wellbore 110, profile device 300 may remain stationary within wellbore 110. As previously discussed, bottom hole assembly 105 (e.g., referring to FIG. 1) may latch into place within profile device 300. In examples, the packer may provide additional support to hold bottom hole assembly 105 in place.

Figure 4:
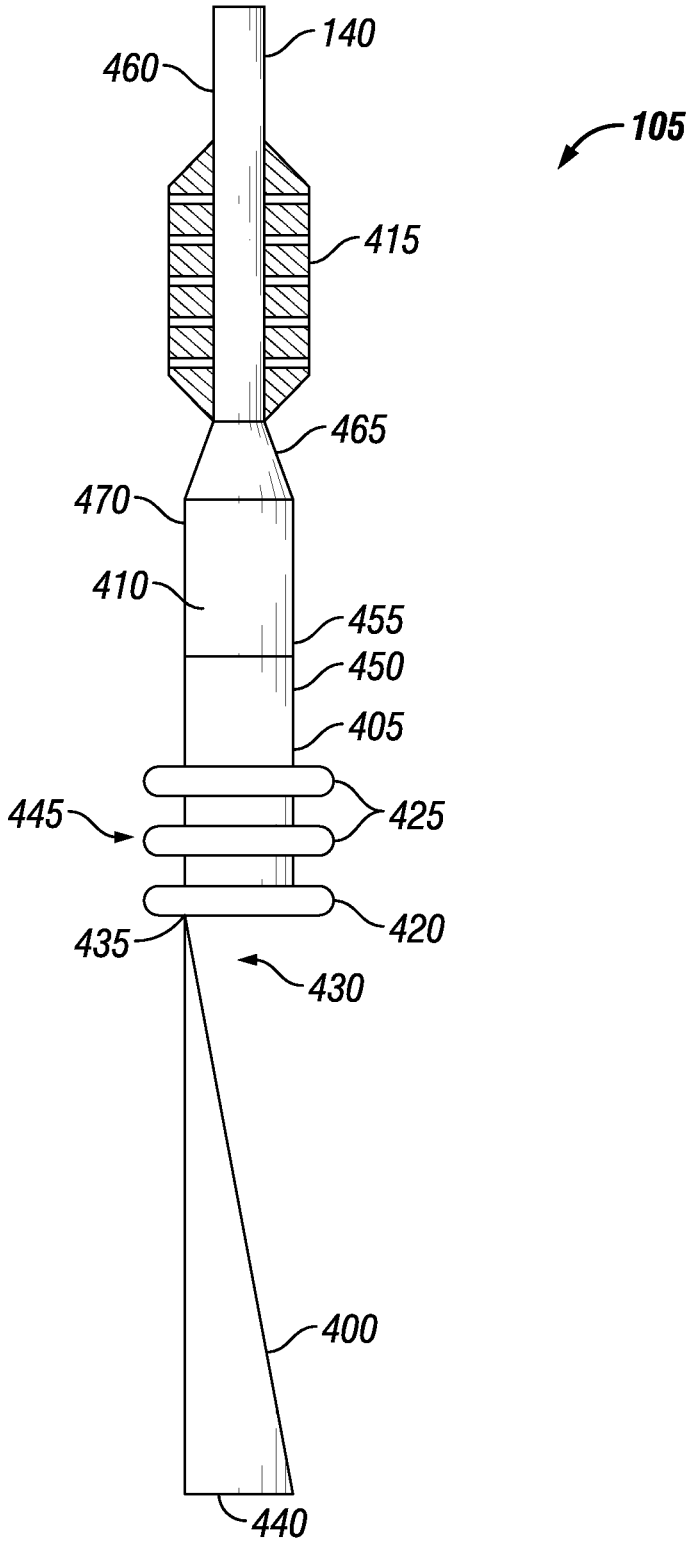
FIG. 4 illustrates an example of a bottom hole assembly.

FIG. 4 illustrates an example of bottom hole assembly 105. Bottom hole assembly 105 may be operable to produce a window exit within an existing well (e.g., wellbore 110 shown on FIG. 1). Bottom hole assembly 105 may be operable to create a long, straight window exit to accommodate the passage of drilling equipment for completion processes. Bottom hole assembly 105 may be operable to weaken inner surface 190 of casing 135 (referring to FIG. 1) of wellbore 110 (referring to FIG. 1) prior to creating a window exit. Bottom hole assembly may comprise of a whipstock 400, a milling assembly 405, a spacer pipe 410, and a downhole subassembly 415.

Whipstock 400 may serve to direct milling assembly 405 into casing 135 (referring to FIG. 1) of wellbore 110 (referring to FIG. 1). Whispstock 400 may be made from any suitable material. Suitable materials may include, but are not limited to, metals, nonmetals, polymers, ceramics, and/or combinations thereof. Whipstock 400 may be any suitable size, height, and/or shape. Without limitation, a suitable shape may include, but is not limited to, cross-sectional shapes that are circular, elliptical, triangular, rectangular, square, hexagonal, and/or combinations thereof. In examples, whipstock 400 may be in the shape of an oblique circular cone or wedge. The cross-sectional area may increase from an end 430 with a tip 435 of the oblique circular cone to a base 440. Milling assembly 405 may be disposed at end 430 of whipstock 400.

Milling assembly 405 may be disposed at tip 435 of whipstock 400 through the use of suitable fasteners. Without limitation, suitable fasteners may include nuts and bolts, washers, screws, pins, sockets, rods and studs, hinges and/or any combination thereof. Milling assembly 405 may be made from any suitable material. Suitable materials may include, but are not limited to, metals, nonmetals, polymers, ceramics, and/or combinations thereof. Milling assembly 405 may be any suitable size, height, and/or shape. Without limitation, a suitable shape may include, but is not limited to, cross-sectional shapes that are circular, elliptical, triangular, rectangular, square, hexagonal, and/or combinations thereof. Milling assembly 405 may comprise of a lead mill 420 and a secondary mill 425. There may be a plurality of secondary mills 425. Lead mill 420 may be attached to a distal end 445 of milling assembly 405 and may be driven either by a downhole motor (not shown) and/or via rotation of conveyance line 140. Secondary mill 425 may be disposed further along milling assembly 405 so as to pass through a trajectory path after lead mill 420. Lead mill 420 and/or secondary mill 425 may be end mills. Without limitation, end mills may include but are not limited to, roughing end mills, finishing end mills, square end mills, ball end mills, rounded edge end mills, tapered end mills, drilling end mills, chamfer end mills, corner rounding end mills, concave radius end mills, convex radius end mills, and the like. An opposing end 450 of milling assembly 405 from lead mill 420 may be disposed at an end 455 of spacer pipe 410.

Spacer pipe 410 may be a designated length of pipe. Spacer pipe 410 may be made from any suitable material. Suitable materials may include, but are not limited to, metals, nonmetals, polymers, ceramics, and/or combinations thereof. Spacer pipe 410 may be any suitable size, height, and/or shape. Without limitation, a suitable shape may include, but is not limited to, cross-sectional shapes that are circular, elliptical, triangular, rectangular, square, hexagonal, and/or combinations thereof. In examples, there may be a plurality of spacer pipes 410 within bottom hole assembly 105. Spacer pipe 410 may serve to provide distance between tools and/or equipment. As illustrated, spacer pipe 410 may be disposed between milling assembly 405 and downhole subassembly 415.

Downhole subassembly 415 may serve to weaken and/or remove material inner surface 190 of casing 135 of wellbore 110 (referring to FIG. 1). Without limitation, downhole subassembly 415 may weaken, erode, deteriorate, split, swell, puncture, and/or miss-shape casing 135 (referring to FIG. 1) in a pre-defined area by means of casing wall removal or casing wall damage with a suitable material. Without limitation, a suitable material may include an abrasive material (e.g., sand, gravel, etc.), fluids, and/or combinations thereof. Downhole subassembly 415 may be made from any suitable material. Suitable materials may include, but are not limited to, metals, nonmetals, polymers, ceramics, and/or combinations thereof. Downhole subassembly 415 may be any suitable size, height, and/or shape. Without limitation, a suitable shape may include, but is not limited to, cross-sectional shapes that are circular, elliptical, triangular, rectangular, square, hexagonal, and/or combinations thereof. In examples, downhole subassembly 415 may have an inner and outer diameter. There may be an opening that traverses the length from one end of downhole subassembly 415 to the other. In examples, the opening may have the same diameter as that of a drill string. In examples, there may be flutes, fins, centralizers, and/or combinations thereof running along the length of downhole subassembly 415. In alternate examples, the flutes, fins, centralizers, and/or combinations thereof may run a portion of the length of downhole subassembly 415. An end 460 of downhole subassembly 415 may be threaded and may be disposed downhole in line with conveyance line 140. An opposing end 465 of downhole subassembly 415 may be threaded and may be disposed at an end 470 of spacer pipe 410. In alternate examples, downhole subassembly 415 may be disposed at an end of milling assembly 405 or whipstock 400. Downhole subassembly 415 may be disposed at any location within bottom hole assembly 105.

In examples, downhole subassembly 415 may jet and/or perforate the inner surface 190 of casing 135 of wellbore 110 (referring to FIG. 1). The following figures may illustrate various examples of downhole subassembly 415. The various examples may perform and operate to produce variations of casing string weakening within wellbore 110.

Figure 5:
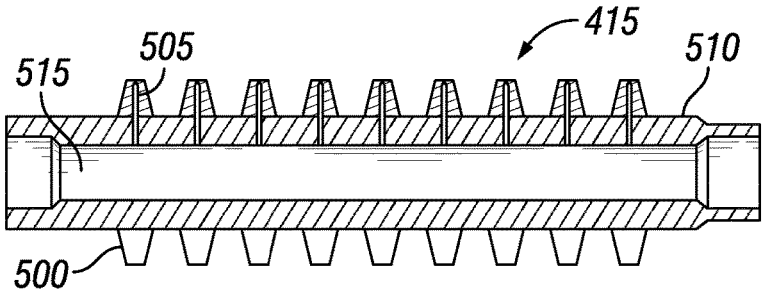
FIGS. 5 and 6 illustrate an example of a downhole subassembly.
Figure 6:
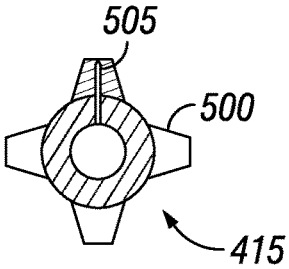

FIGS. 5 and 6 illustrate an example of downhole subassembly 415. Downhole subassembly 415 may comprise a centralizer 500 and a nozzle 505. Downhole subassembly 415 may also comprise a body portion 510. Centralizer 500 and nozzle 505 may be disposed on body portion 510. Body portion 510 may include a through passage 515 extending through its length. Centralizer 500 may be any suitable mechanical device that may be secured around a drill string to keep the drill string from contacting the walls of wellbore 110 (e.g., referring to FIG. 1). In examples, there may be a plurality of centralizers 500 disposed in series along the length of downhole subassembly 415. Centralizers 500 may be rigid and/or fluted. In examples, centralizers 500 may be in close proximity to inner surface 190 of casing 135 (referring to FIG. 1) of wellbore 110. Centralizers 500 may be arranged in any configuration around body portion 510. In examples, centralizers 500 may be arranged in a line. As illustrated, nozzle 505 may be disposed in centralizers 500. In examples, not all centralizers 500 may contain nozzles 505. Nozzles 505 may run the length from the inner diameter of downhole subassembly 415 to the end of centralizers 500. Fluid may be flowed through nozzles 505 to erode or otherwise weaken casing string (e.g., referring to FIG. 1). Nozzles 505 may be designed to control the direction and characteristics of a fluid flow.

Figure 7:
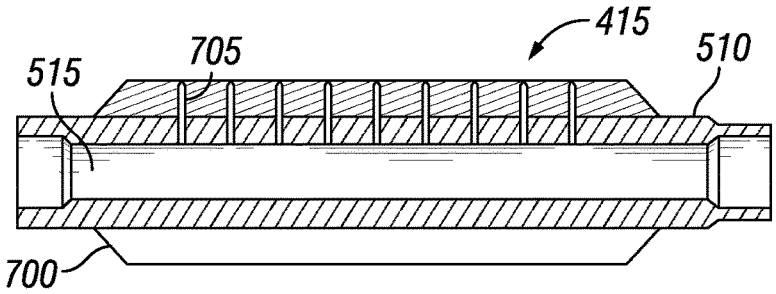
FIGS. 7 and 8 illustrate an example of a downhole subassembly.
Figure 8:
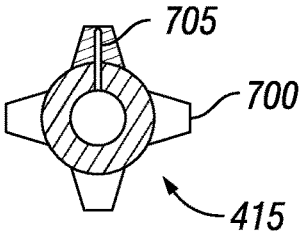

FIGS. 7 and 8 illustrate another example of downhole subassembly 415. Downhole subassembly 415 may comprise a fin 700 and a nozzle 705. Downhole subassembly 415 may also comprise a body portion 510. Fin 700 and nozzle 705 may be disposed on body portion 510. Fin 700 may serve a similar purpose to centralizer 500 (referring to FIGS. 5 and 6) by preventing contact with the walls of wellbore 110 (referring to FIG. 1). In examples, there may be a plurality of fins 700. Fins 700 may run along the length of body portion 510. Fins 700 may also be rigid and/or fluted. In examples, fins 700 may be in close proximity to inner surface 190 of casing 135 (referring to FIG. 1) of wellbore 110. As illustrated, a plurality of nozzles 705 may be spaced along the length of body portion 510. Nozzles 705 may be disposed in fins 700. In examples, not all fins 700 may contain nozzles 705. Nozzles 705 may run the length from a through passage 515 of body portion 510 to the end of fins 700. Fluid may be flowed through nozzles 505 to erode or otherwise weaken casing string (e.g., referring to FIG. 1). Nozzles 705 may be designed to control the direction and characteristics of a fluid flow.

Figure 9:
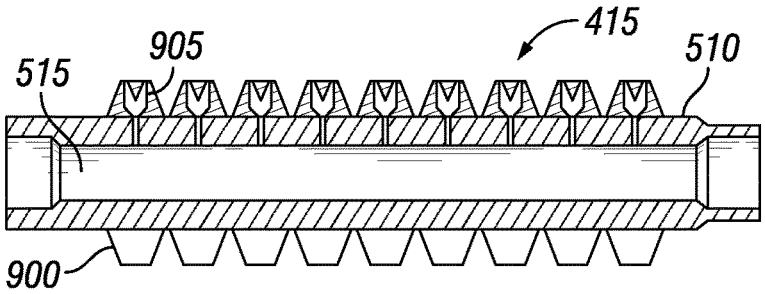
FIGS. 9 and 10 illustrate an example of a downhole subassembly.
Figure 10:
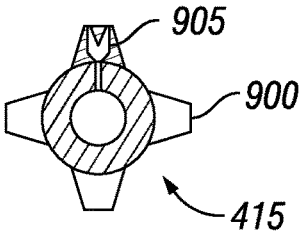

FIGS. 9 and 10 illustrate another example of downhole subassembly 415. Downhole subassembly 415 may comprise a centralizer 900 and a shaped charge 905. Downhole subassembly 415 may also comprise a body portion 510. Centralizer 500 and nozzle 500 may be disposed on body portion 510. As previously described, centralizer 900 may prevent contact with the walls of wellbore 110 (referring to FIG. 1). As illustrated, there may be plurality of centralizes 90 disposed on body portion 510. As illustrated, shaped charge 905 may be disposed in centralizers 900. In examples, not all centralizers 900 may contain shaped charges 905. Shaped charges 905 may run the length from a through passage 515 of body portion 510 to the end of centralizers 900. Shaped charges 905 may comprise of any suitable explosive material to be detonated, thereby causing a perforation within casing 135 (referring to FIG. 1). Without limitation, detonation may be initiated via pressure, electromagnetic pulse, timers, and/or combinations thereof.

Figure 11:
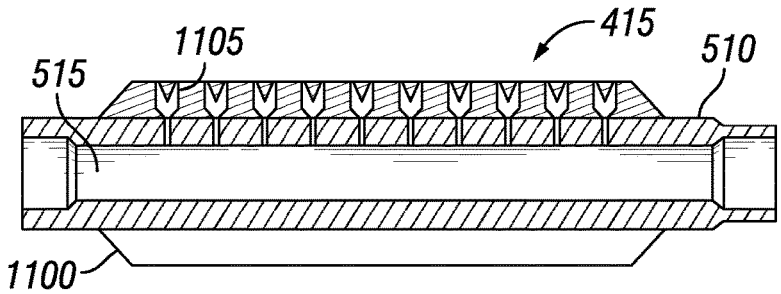
FIGS. 11 and 12 illustrate an example of a downhole subassembly.
Figure 12:
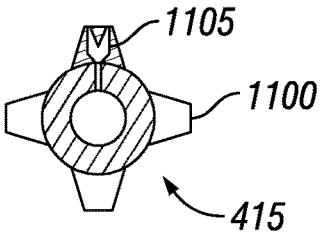

FIGS. 11 and 12 illustrate another example of downhole subassembly 415. Downhole subassembly 415 may comprise a fin 1100 and a shaped charge 1105. Downhole subassembly 415 may also comprise a body portion 510. Fin 1100 and shaped charge 1105 may be disposed on body portion 510. As previously described, fins 1100 may run the length of downhole subassembly 415 and prevent contact with the walls of wellbore 110 (referring to FIG. 1). As illustrated, shaped charge 1105 may be disposed in fins 1100. In examples, not all fins 1100 may contain shaped charges 1105. Shaped charges 1105 may run the length from a through passage 515 of body portion 510 to the end of fins 1100. As previously described, shaped charges 1105 may detonate to produce a perforation within casing 135 (referring to FIG. 1).

Figure 13:
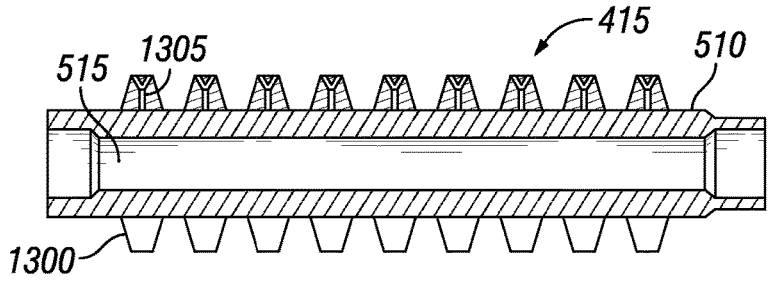
FIGS. 13 and 14 illustrate an example of a downhole subassembly.
Figure 14:
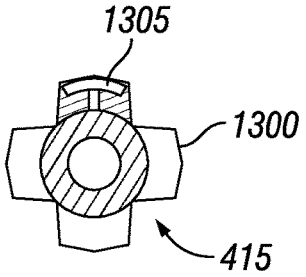

FIGS. 13 and 14 illustrate another example of downhole subassembly 415. Downhole subassembly 415 may comprise a centralizer 1300 and a linear charge 1305. Downhole subassembly 415 may also comprise a body portion 510. Centralizer 1300 and linear charge 1305 may be disposed on body portion 510. As previously described, centralizer 1300 may prevent contact with the walls of wellbore 110 (referring to FIG. 1). As illustrated, linear charge 1305 may be disposed in centralizers 1300. In examples, not all centralizers 1300 may contain linear charges 1305. Linear charges 1305 may be contained within centralizers 1300. Linear charges 1305 may not have access to a through passage 515 of downhole subassembly 415. Linear charges 1305 may differ from shaped charges in that linear charges 1305 may contain a lining with a V-shaped profile and varying length. Linear charges 1305 may detonate to produce a perforation within casing 135 (referring to FIG. 1).

Figure 15:
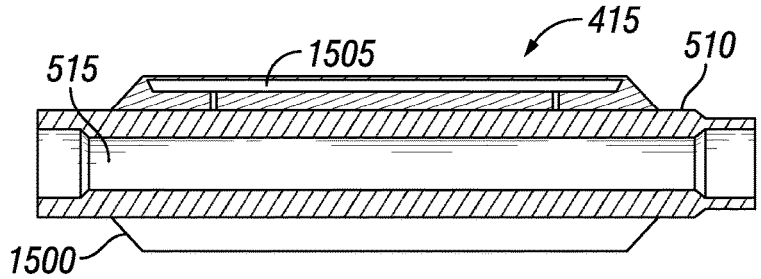
FIGS. 15 and 16 illustrate an example of a downhole subassembly.
Figure 16:
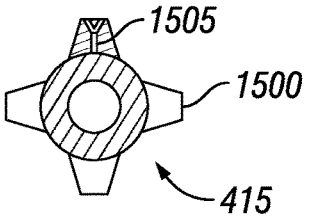

FIGS. 15 and 16 illustrate another example of downhole subassembly 415. Downhole subassembly 415 may comprise a fin 1500 and a linear charge 1505. Downhole subassembly 415 may also comprise a body portion 510. Fin 1500 and linear charge 1505 may be disposed on body portion 510. As previously described, fins 1500 may run the length of downhole subassembly 415 and prevent contact with the walls of wellbore 110 (referring to FIG. 1). As illustrated, linear charge 1505 may be disposed in fins 1500. In examples, not all fins 1500 may contain linear charge 1505. Linear charges 1305 may not have access to a through passage 515 of downhole subassembly 415. Linear charge 1505 may run the length of fin 1500. Linear charge 1505 may detonate to produce a perforation within casing 135 (referring to FIG. 1).

Figure 17A:
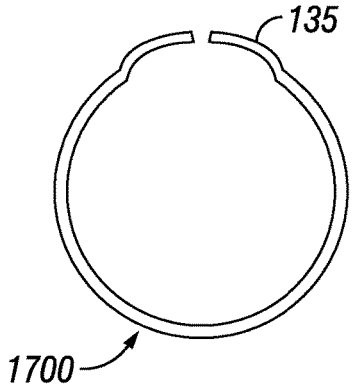
FIGS. 17*a*-17*c* illustrate examples of resultant casing string profiles.
Figure 17B:
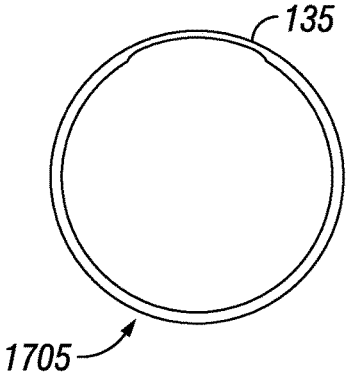
Figure 17C:
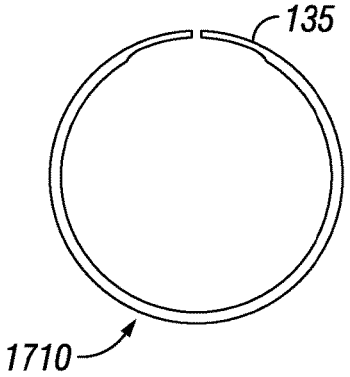

FIGS. 17*a* to 17*c* illustrate comparisons between different examples of downhole subassembly 415. After perforation and/or jetting, casing 135 may be affected differently depending on the operation used. A first cross-section 1700 may be depicted in FIG. 17*a*. A second cross-section 1705 may be depicted in FIG. 17*b*, and a third cross-section 1710 may be depicted in FIG. 17*c*. First cross-section 1700 may be the resultant profile of perforating with a linear shaped charge. Second cross-section 1705 may be the resultant profile of jetting through nozzles. As illustrated in FIG. 17*b*, casing 135 did not break through after the jetting operation. Third cross-section 1710 on FIG. 17*c* may be the resultant profile of jetting through nozzles. As illustrated, casing 135 broke through during and/or after the jetting operation. An operator may choose a specific example of downhole subassembly 415 to use in order to get a desired effect on casing 135.

In examples, placement of downhole subassembly 415 may be dependent on the type of operation to be performed. In examples, if an operator wants to perforate through casing 135, downhole subassembly 415 may be disposed below whipstock 400 (e.g., referring to FIG. 4). If an operator wants to use jetting nozzles, downhole subassembly 415 may be disposed towards the top of the bottom hole assembly 105 (e.g., as seen in FIG. 4).

Figure 18:
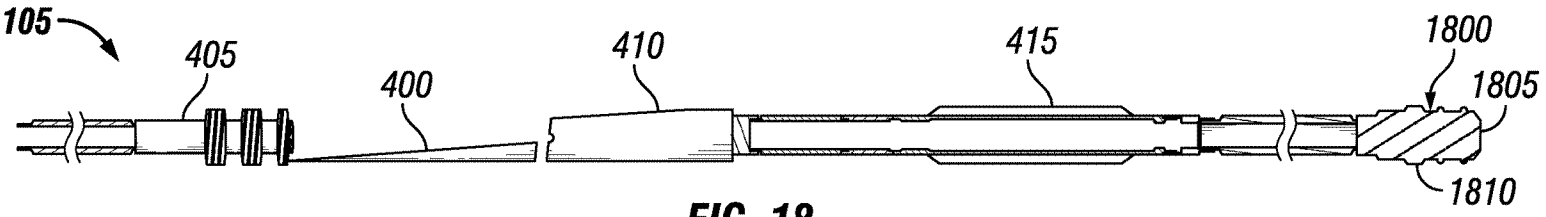
FIG. 18 illustrates an example of a bottom hole assembly for perforation.

FIG. 18 illustrates an example of bottom hole assembly 105 for perforation. As illustrated, a coupling component 1800 may be disposed at an end of bottom hole assembly 105. Coupling component 1800 may serve to secure into profile device 300 (e.g., referring to FIG. 3). Coupling component 1800 may include a body portion 1805 and one or more protrusions 1810. Protrusions 1810 may engage profile device 300 to secure coupling component 1800 in profile device 300. Coupling component 1800 may be made from any suitable material. Suitable materials may include, but are not limited to, metals, nonmetals, polymers, ceramics, and/or combinations thereof. Coupling component 1800 may be any suitable size, height, and/or shape. Without limitation, a suitable shape may include, but is not limited to, cross-sectional shapes that are circular, elliptical, triangular, rectangular, square, hexagonal, and/or combinations thereof. In examples, coupling component 1800 may have ridges and/or grooves that accommodate the inner diameter of profile device 300. There may be a plurality of profile devices 300 disposed within casing 135 (referring to FIG. 1).

As illustrated, bottom hole assembly 105 may also include whipstock 400, milling assembly 405, spacer pipe 410, downhole subassembly 415 (as previously described). Downhole subassembly 415 may be disposed at an end of coupling component 1800. In examples, downhole subassembly 415 may be designed to perforate casing 135 of wellbore 110 (e.g., referring to FIG. 1). An opposing end of downhole subassembly 415 may be disposed at an end of spacer pipe 410. As illustrated, downhole subassembly 415 may be disposed between coupling component 1800 and spacer pipe 410.

Figure 19:
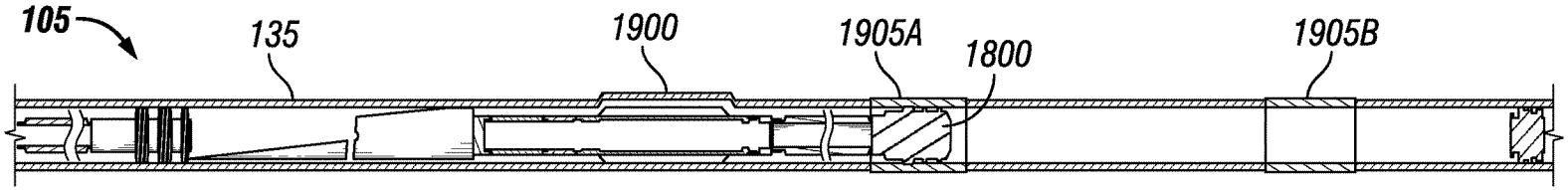
FIG. 19 illustrates an example of a bottom hole assembly within a casing string.

FIG. 19 illustrates an example of bottom hole assembly 105 within casing 135. As bottom hole assembly 105 is being disposed through casing 135 of wellbore 110 (e.g., referring to FIG. 1), coupling component 1800 may come into contact with a first profile device 1905A. Coupling component 1800 may be temporarily secured within first profile device 1905A to prevent further movement of bottom hole assembly 105, for example, by engagement of protrusions 1810 within first profile device 1905A. Bottom hole assembly 105 may rotate at a low speed to latch coupling component 1800 into first profile device 1905A. In examples, confirmation of proper latching may occur by setting down the weight of bottom hole assembly 105. While latching is described with rotation, other techniques may be used for latching that do not require rotation. Downhole subassembly 415 may align up with a weakened zone 1900. Weakened zone 1900 may allocate a portion of casing 135 that is to be affected by operation of downhole subassembly 415 As illustrated, after operation of downhole subassembly 415, casing 135 may be physically altered. Once weakened zone 1900 is produced, the window exiting procedure may commence.

Figure 20:
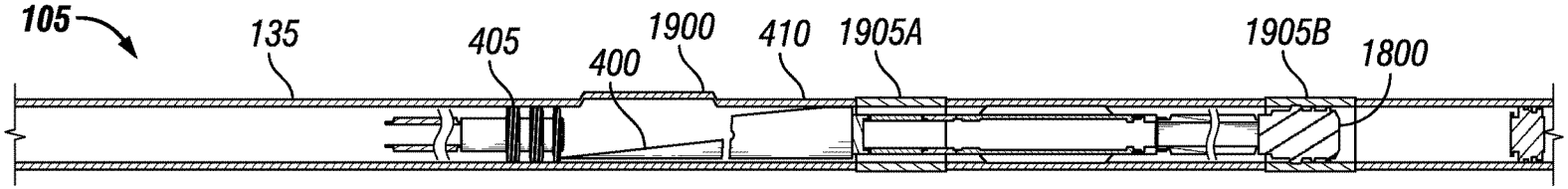
FIG. 20 illustrates an example of a bottom hole assembly within a casing string.

FIG. 20 illustrates an example of bottom hole assembly 105 within casing 135. In examples, after operation of downhole subassembly 415 to produce weakened zone 1900, coupling component 1800 may be actuated to pass through first profile device 1905A. Bottom hole assembly 105 may unlatch coupling component 1800 from first profile device 1905A. Bottom hole assembly 105 may continue to be displaced further through casing string until coupling component 1800 interacts with a second profile device 1905B. Coupling component 1800 may be temporarily secured within second profile device 1905B further downhole. Bottom hole assembly 105 may rotate at a low speed to latch coupling component 1800 into second profile device 1905B. In examples, confirmation of proper latching may occur by setting down the weight of bottom hole assembly 105. In examples, the distance between first profile device 1905A and second profile device 1905B may be the same as the length of spacer pipe 410. The length of spacer pipe 410 may help to align whipstock 400 with weakened zone 1900. In examples, as whipstock 400 is aligned with weakened zone 1900, the drilling path for milling assembly 405 may subsequently be aligned with weakened zone 1900 as milling assembly 405 travels along whipstock 400.

Figure 21:
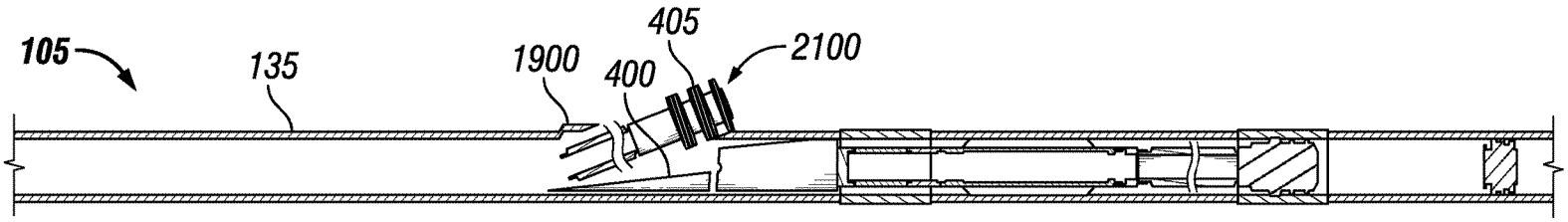
FIG. 21 illustrates an example of a bottom hole assembly creating a window exit.
Figure 22:
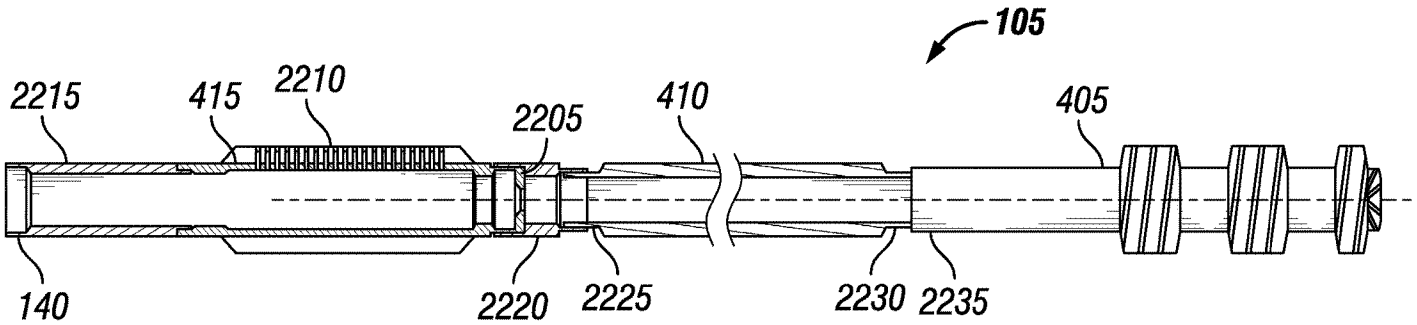
FIGS. 22-26 illustrate an example of a bottom hole assembly for jetting.

FIG. 21 illustrates an example of bottom hole assembly 105 creating a window exit 2100. Once whipstock 400 is aligned with weakened zone 1900, milling assembly 405 may be actuated to disconnect from whipstock 400. A suitable fastener may connect an end of milling assembly 405 to an end of whipstock 400. Suitable fasteners may include a running bolt or other suitable fastener. To disconnect milling assembly 405 from whipstock 400, milling assembly 405 may be actuated by applying torque and setting down the weight of bottom hole assembly 105 to shear the suitable fastener connecting them together. Once disconnected, milling assembly 405 may be actuated to travel along whipstock 400 into weakened zone 1900. Whipstock 400 may comprise an inclined ramp. Milling assembly 405 may be in operation as it travels into weakened zone 1900. In examples, milling assembly 405 may approach weakened zone 1900 at a suitable angle. Milling assembly 405 may travel along the length of the inclined ramp wherein the suitable angle may be represented by the angle formed between the inclined ramp and the wall of wellbore 110 (referring to FIG. 1). As milling assembly 405 passes through casing 135 of wellbore 110 to create window exit 2100, milling assembly 405 may continue to travel through formation 120 (referring to FIG. 1) at the suitable angle. In examples, milling assembly 405 may continue to travel as specified by an operator. In examples, as a desired distance is reached, bottom hole assembly 105 may be removed from wellbore 110 and completion equipment may be employed into the newly created window. A rotary steerable assembly may be run in hole to further drill through the window.

In examples, the process for using downhole subassembly 415 for jetting material into casing 135 may be similar to that of using downhole subassembly 415 for perforation. The operation and placement of downhole subassembly 415 within bottom hole assembly 105 may be different. FIGS. 22-26 illustrate an example of bottom hole assembly 105 for jetting. As illustrated, an end 2215 of downhole subassembly 415 may be coupled to conveyance line 140. An opposing end 2220 of downhole subassembly 415 may be disposed at an end 2225 of spacer pipe 410. An opposing end 2230 of spacer pipe 410 may be disposed at an end 2235 of milling assembly 405. Milling assembly 405 may be disposed at an end of whipstock 400 (not shown). In examples, coupling component 1800 (referring to FIG. 18) may be disposed at the opposing end of whipstock 400 (e.g., referring to FIG. 4), rather than spacer pipe 410.

The remaining equipment within bottom hole assembly 105 may function as previously described. Whipstock 400 may direct milling assembly 405 into weakened zone 1900 (e.g., referring to FIG. 19). Coupling component 1800 may secure into profile device 300 (e.g, referring to FIG. 3) to prevent further movement of bottom hole assembly 105 and may be disposed about an end of whipstock 400. As downhole subassembly 415 may be disposed above milling assembly 405, coupling component 1800 may be secured into a profile device 300 further along wellbore 110 (e.g., referring to FIG. 1). After operation of downhole subassembly 415, coupling component 1800 may travel back towards the surface to be secured in a previous profile device 300 to align milling assembly 405 with weakened zone 1900.

Figure 23:
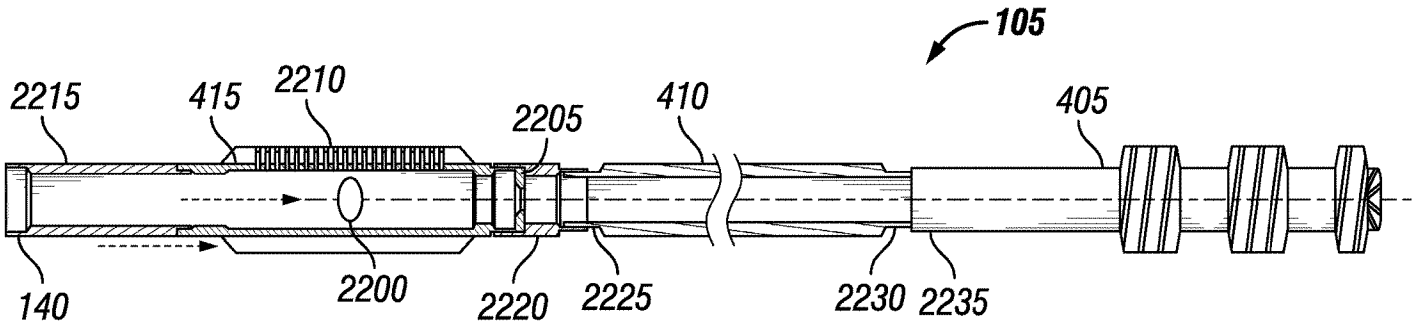
Figure 24:
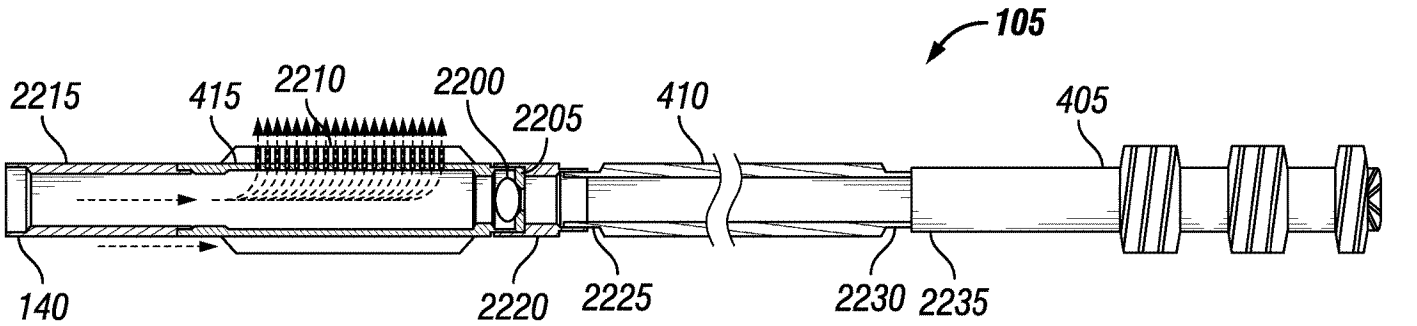
Figure 25:
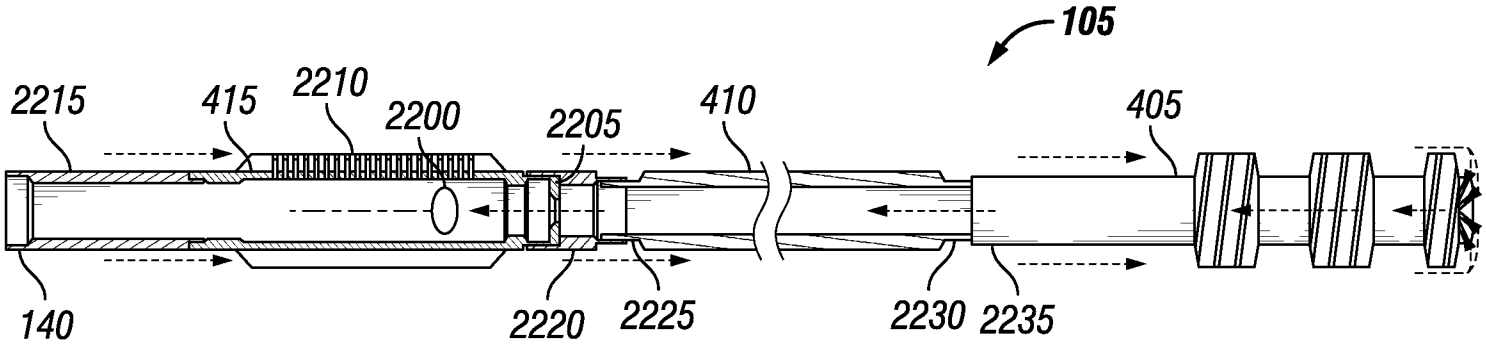
Figure 26:
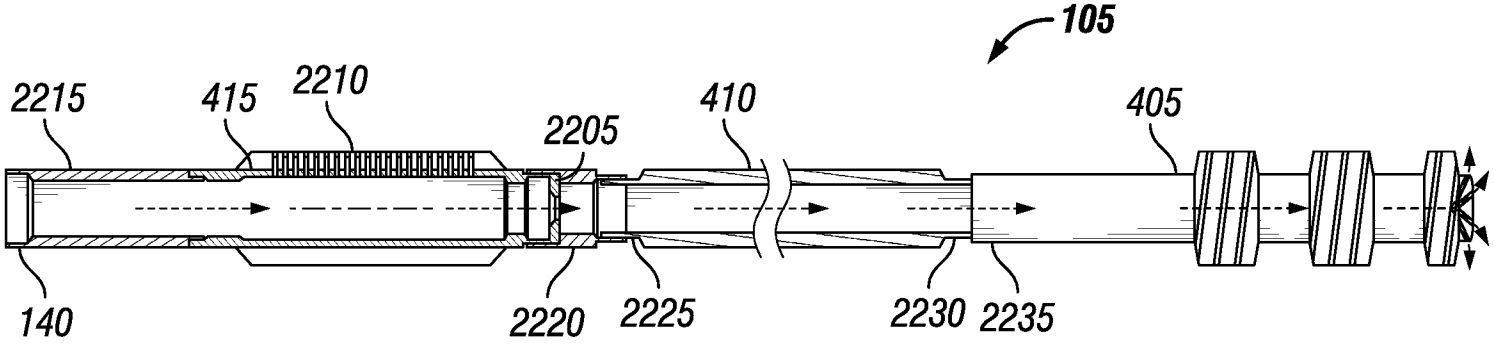

As illustrated in FIGS. 22-26, once bottom hole assembly 105 is secured within casing 135 of wellbore 110 (e.g., referring to FIG. 1), a ball 2200 may be deployed. Ball 2200 may be dropped from the surface into wellbore 110, as illustrated in FIG. 23. In examples, ball 2200 may settle into a seat 2205 within downhole subassembly 415. Seat 2205 may serve to receive ball 2200, thereby creating a seal within downhole subassembly 415. The seal may prevent fluid and/or material flow through downhole subassembly 415. Nozzles 2210 within downhole subassembly 415 may redirect the fluid and/or material flow, as illustrated by FIG. 24, towards casing 135 of wellbore 110. Damage may be done to inner surface 190 of casing 135 (referring to FIG. 1), and weakened zone 1900 (e.g., referring to FIG. 19) may form. After operation of downhole subassembly 415, ball 2200 may be expelled from bottom hole assembly 105 via a shearable sleeve (not illustrated). The shearable sleeve may be acted upon by downhole actuators that may apply a mechanical and/or hydraulic force. Signals may be sent by remote telemetry to instruct the downhole actuators to shear the shearable sleeve.

Bottom hole assembly 105 may be repositioned so as to align the path that milling assembly 405 travels into weakened zone 1900. Milling assembly 405 may be actuated to disconnect from whipstock 400 (referring to FIG. 4) and may travel into weakened zone 1900 to create an exit window from wellbore 110. In examples, as a desired distance is reached, bottom hole assembly 105 may be removed from wellbore 110 (referring to FIG. 1) and completion equipment may be employed into the newly created window.

The systems and methods for creating a window exit may include any of the various features of the systems and methods disclosed herein, including one or more of the following statements.

Statement 1. A bottom hole assembly, comprising: a milling assembly; a whipstock coupled to the milling assembly, wherein the whipstock comprises an inclined ramp configured for diverting the milling assembly toward a casing string; and a downhole subassembly coupled to the whipstock, wherein the downhole subassembly comprises a body portion and one or more components on the body portion operable to weaken and/or remove material from the casing string.

Statement 2. The bottom hole assembly of statement 1, further comprising a coupling component disposed at a distal end of the bottom hole assembly, wherein the coupling component is operable for attachment to a profile device to secure the bottom hole assembly at a position in a wellbore.

Statement 3. The bottom hole assembly of statement 1 or 2, wherein the downhole subassembly comprises centralizers disposed on the body portion, and wherein the one or more components comprise charges to be detonated.

Statement 4. The bottom hole assembly of statement 3, wherein the charges to be detonated comprise shaped charges or linear charges.

Statement 5. The bottom hole assembly of any of the previous statements, wherein the downhole subassembly comprises fins disposed on the body portion, wherein the one or more components comprise charges to be detonated.

Statement 6. The bottom hole assembly of statement 5, wherein the charges to be detonated comprise shaped charges or linear charges.

Statement 7. The bottom hole assembly of any of the previous statements, wherein the downhole subassembly comprises centralizers on the body portion, wherein the one or more components comprise nozzles for delivery of a fluid.

Statement 8. The bottom hole assembly of any of the previous statements, wherein the downhole subassembly comprises fins on the body portion, wherein the one or more components comprise nozzles for delivery of at least one material selected from the group of a fluid, an abrasive material, or combinations thereof.

Statement 9. The bottom hole assembly of any of the previous statements, wherein the downhole subassembly is actuated by pressure, electromagnetic pulse, or a timer.

Statement 10. The bottom hole assembly of any of the previous statements, wherein the body portion comprises a through passage and a seat within the body portion, wherein the seat is operable to receive a ball dropped through the through passage to actuate the downhole subassembly.

Statement 11. The bottom hole assembly of any of the previous statements, wherein the milling assembly comprises a lead mill and a secondary mill.

Statement 12. The bottom hole assembly of any of the previous statements, further comprising a spacer pipe, wherein the spacer pipe is disposed between the milling assembly and the downhole subassembly.

Statement 13. A method for creating a window in a casing string, comprising: disposing a bottom hole assembly into a wellbore through the casing string; securing the bottom hole assembly at a location in the wellbore; actuating a downhole subassembly to create a weakened zone of the casing string; and drilling through the weakened zone of the casing string with a milling assembly of the bottom hole assembly.

Statement 14. The method of statement 13, wherein the actuating the downhole subassembly comprises actuating one or more perforating charges contained within the downhole subassembly.

Statement 15. The method of statement 13 or 14, wherein the actuating the downhole subassembly comprises of jetting material through nozzles contained within the downhole subassembly.

Statement 16. The method of any of statements 13 to 15, wherein the drilling through the weakened zone of the casing string comprises of moving the milling assembly along an inclined ramp of a whipstock to engage the weakened zone.

Statement 17. The method of any of statements 13 to 16, wherein the securing the bottom hole assembly at the location comprises latching a coupling component of the bottom hole assembly into a first profile device disposed in the wellbore.

Statement 18. The method of any of statements 13 to 17, further comprising: unlatching the coupling component from the first profile device; and securing the bottom hole assembly into a second profile device at another location in the wellbore.

Statement 19. A downhole system, comprising: a conveyance line; and a bottom hole assembly attached to the conveyance line, wherein the bottom hole assembly comprises: a milling assembly; a whipstock coupled to the milling assembly, wherein the whipstock comprises an inclined ramp configured for diverting the milling assembly toward a casing string; and a downhole subassembly coupled to the whipstock, wherein the downhole subassembly comprises a body portion and one or more components on the body portion operable to weaken and/or remove material from the casing string.

Statement 20. The downhole system of statement 19, further comprising a coupling component and a profile device.

Although the present invention and its advantages have been described in detail, it should be understood that various changes, substitutions and alterations may be made herein without departing from the spirit and scope of the invention as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A bottom hole assembly, comprising:

a milling assembly;

a whipstock coupled to the milling assembly, wherein the whipstock comprises an inclined ramp operable to divert the milling assembly toward a casing string;

a downhole subassembly comprising a body portion and one or more components on the body portion operable to weaken and/or remove material from the casing string;

a coupling component disposed downhole from the milling assembly, the whipstock, and the downhole subassembly;

a first profile device operable to receive and removably secure the coupling component to align the downhole subassembly with a section of the casing string; and a second profile device operable to receive and removably secure the coupling component to align the milling assembly with the section of the casing string, the second profile device coaxially aligned with the first profile device.

2. The bottom hole assembly of claim 1, wherein the coupling component is disposed at a distal end of the bottom hole assembly, wherein the coupling component is operable for attachment to a profile device to secure the bottom hole assembly at a position in a wellbore.

3. The bottom hole assembly of claim 1, wherein the downhole subassembly comprises centralizers disposed on the body portion, and wherein the one or more components comprise charges to be detonated.

4. The bottom hole assembly of claim 3, wherein the charges to be detonated comprise shaped charges or linear charges.

5. The bottom hole assembly of claim 1, wherein the downhole subassembly comprises fins disposed on the body portion, wherein the one or more components comprise charges to be detonated.

6. The bottom hole assembly of claim 5, wherein the charges to be detonated comprise shaped charges or linear charges.

7. The bottom hole assembly of claim 1, wherein the downhole subassembly comprises centralizers on the body portion, wherein the one or more components comprise nozzles for delivery of a fluid.

8. The bottom hole assembly of claim 1, wherein the downhole subassembly comprises fins on the body portion, wherein the one or more components comprise nozzles for delivery of at least one material selected from the group of a fluid, an abrasive material, or combinations thereof.

9. The bottom hole assembly of claim 1, wherein the downhole subassembly is actuated by pressure, electromagnetic pulse, or a timer.

10. The bottom hole assembly of claim 1, wherein the body portion comprises a through passage and a seat within the body portion, wherein the seat is operable to receive a ball dropped through the through passage to actuate the downhole subassembly.

11. The bottom hole assembly of claim 1, wherein the milling assembly comprises a lead mill and a secondary mill.

12. The bottom hole assembly of claim 1, further comprising a spacer pipe, wherein the spacer pipe is disposed between the milling assembly and the downhole subassembly.

13. A method for creating a window in a casing string, comprising:

disposing a bottom hole assembly into a wellbore through the casing string, the bottom hole assembly comprising:

a milling assembly;

a whipstock coupled to the milling assembly, wherein the whipstock comprises an inclined ramp operable to divert the milling assembly toward a casing string;

a downhole subassembly comprising a body portion and one or more components on the body portion operable to weaken and/or remove material from the casing string; and a coupling component disposed downhole from the milling assembly, the whipstock, and the downhole subassembly;

removably securing the bottom hole assembly to a first profile device to align the downhole subassembly with a section of the casing string;

actuating the downhole subassembly to weaken the section of the casing string to provide a weakened section of the casing string;

unlocking the bottom hole assembly from the first profile device;

moving the bottom hole assembly from the first profile device to a second profile device to align the milling assembly with the weakened section of the casing string, without removing the bottom hole assembly from the wellbore;

securing the bottom hole assembly to the second profile device; and milling through the weakened section of the casing string with the milling assembly.

14. The method of claim 13, wherein the actuating the downhole subassembly comprises actuating one or more perforating charges contained within the downhole subassembly.

15. The method of claim 13, wherein the actuating the downhole subassembly comprises of jetting material through nozzles contained within the downhole subassembly.

16. The method of claim 13, wherein the milling comprises moving the milling assembly along an inclined ramp of the whipstock to engage the section of the casing string.

17. The method of claim 13, wherein the securing the bottom hole assembly at the location comprises latching the coupling component of the bottom hole assembly into the first profile device disposed in the wellbore.

18. The method of claim 17, wherein the unlocking comprises:

unlatching the coupling component from the first profile device; and securing the bottom hole assembly into the second profile device at another location in the wellbore.

19. A downhole system, comprising:

a conveyance line; and a bottom hole assembly attached to the conveyance line, wherein the bottom hole assembly comprises:

a milling assembly;

a whipstock coupled to the milling assembly, wherein the whipstock comprises an inclined ramp operable to divert the milling assembly toward a casing string;

a downhole subassembly comprising a body portion and one or more components on the body portion operable to weaken and/or remove material from the casing string;

a coupling component disposed downhole from the milling assembly, the whipstock, and the downhole subassembly;

a first profile device operable to receive and removably secure the coupling component to align the downhole subassembly with a section of the casing string; and a second profile device operable to receive and removably secure the coupling component to align the milling assembly with the section of the casing string, the second profile device coaxially aligned with the first profile device.

20. The downhole system of claim 19, wherein the first profile device is disposed up-hole to the second profile device or wherein the first profile device is disposed downhole from the second profile device.

* * * * *